US010701478B1

(12) United States Patent
Mathur

(10) Patent No.: US 10,701,478 B1
(45) Date of Patent: Jun. 30, 2020

(54) META ACOUSTIC HORN SYSTEM FOR AUDIO AMPLIFICATION AND THE METHOD TO MAKE THE SAME

(71) Applicant: Acoustic Metamaterials LLC, Scarsdale, NY (US)

(72) Inventor: Gopal Prasad Mathur, Trabuco Canyon, CA (US)

(73) Assignee: ACOUSTIC METAMATERIALS LLC, Scarsdale, NY (US)

( * ) Notice: Subject to any disclaimer, the term of this patent is extended or adjusted under 35 U.S.C. 154(b) by 0 days.

(21) Appl. No.: 16/445,280

(22) Filed: Jun. 19, 2019

(51) Int. Cl.
*H04R 1/28* (2006.01)
*H04R 1/02* (2006.01)

(52) U.S. Cl.
CPC ..... *H04R 1/2857* (2013.01); *H04R 1/025* (2013.01)

(58) Field of Classification Search
CPC .. H04R 1/2853; H04R 1/2857; H04R 1/2861; H04R 1/2865; H04R 1/30; G10K 11/00; G10K 11/02; G10K 11/025; G10K 11/04; G10K 11/08; G10K 11/18; G10K 11/26
See application file for complete search history.

(56) References Cited

U.S. PATENT DOCUMENTS 4,168,761 A * 9/1979 Pappanikolaou .... H04R 1/2857 181/152
2013/0175307 A1* 7/2013 Izen ..... B65D 81/00 224/269
2014/0056458 A1* 2/2014 Bothe ..... H04R 1/345 381/340
2014/0193019 A1* 7/2014 Yan ..... H04R 1/30 381/342
2014/0367193 A1* 12/2014 Center ..... H04R 1/02 181/199

* cited by examiner

*Primary Examiner* — Walter F Briney, III
(74) *Attorney, Agent, or Firm* — Michael J. Feigin, Esq.; Feigin and Fridman LLC

(57) ABSTRACT

A meta acoustic horn (MAHI) device for passive amplification of sound is described. The MAH audio amplifier device employs a deep sub-wavelength acoustic meta material horn design with high refraction index, which provides amplification of the sound over large audio frequency range. An array of sub-wavelength, zig-zag channels, contained in a horn-like micro channel is devised, to achieve amplification of sound. This is accomplished by varying the width and port opening of the channel in a fixed ratio, called MAH ratio, opening extending in a same, common, or substantially common direction. The sound emanating from a speaker enters the opening of the MAH channel and comes out amplified at the output port. The sound from the speaker is in all transmitted frequencies of, for example, a musical recording or the like. All frequencies of the original sound thereof are substantially propagated through the MAH channel, and are amplified.

18 Claims, 8 Drawing Sheets

META ACOUSTIC HORN SYSTEM FOR AUDIO AMPLIFICATION AND THE METHOD TO MAKE THE SAME

FIELD OF THE DISCLOSED TECHNOLOGY

The present disclosure relates generally to passive amplification of acoustic sound using meta acoustic horn devices, and, more specifically for amplification of sound emanating from loudspeakers and other acoustic transducers over a broadband frequency range.

BACKGROUND OF THE DISCLOSED TECHNOLOGY

It is well known that a directly radiating loudspeaker is unable to achieve high radiation efficiency at low frequencies. For example, a loudspeaker diaphragm with a diameter of 25 cm has a radiation efficiency of 0.7% at 50 Hz when mounted in an infinite baffle; this efficiency falls to about half when mounted in a cabinet (See the Newell and Holland reference cited in the Information Disclosure Statement). An "acoustic horn" or "waveguide" is defined, for purposes of this disclosure, as a tapered sound guide designed to provide an acoustic impedance match between a sound source and free air. An acoustic horn is designed for efficiently transferring sound waves from the particular source are transferred to the air.

Horns are some of the most commonly used tools in acoustics. They have been used for centuries for passively amplifying sounds. Horns are acoustic elements specially designed for maximum transmission of sound pressure, for example, in sound systems. Horn systems are capable of giving a closer approximation of musical reality.

Horns were the earliest form of acoustic amplification. An acoustic horn is an acoustic waveguide designed to provide an acoustic impedance match between a sound source and free air. This has the effect of maximizing the efficiency with which sound waves from the particular source are transferred to the air. Horns do not use electricity. The problem with conventional acoustic horns is that amplification is limited.

FIG. 1 shows a prior art exponential horn. The acou stic horn is used to increase the overall efficiency of the driver. A horn effectively guides the motion of sound waves and thus substantially increases the sensitivity and effectiveness of sound radiation. A horn is a natural and powerful way to amplify sound. The horn may be viewed as an acoustic impedance transformer. When a diaphragm vibrates, pressure waves are created in front of it. This is the sound we hear. Coupling the motion of the diaphragm to the air is not an easy thing to do due to the very different densities of the vibrating diaphragm and air. This can be viewed as an impedance mismatch. Sound travels better in high density materials than in low density materials, and in a speaker system, the diaphragm is the high density (high impedance) medium and air is the low density (low impedance) medium. The horn assists the solid-air impedance transformation by acting as an intermediate transition medium. In other words, it creates a higher acoustic impedance for the transducer to work into, thus allowing more power to be transferred to the air. A contributor to the higher efficiency of horn loudspeakers is the fact that they are better matching acoustical impedances of the source of the sound and the so-called load (air). The higher pressure increases the external impedance—which is naturally low due to low air density—to (better) match the impedance of the source. In (conventional) direct radiating loudspeakers this mismatch leads to a lot of energy being converted to heat within the driver instead of into the sound wave.

A horn is defined as, for purposes of this disclosure, a tube whose cross-section increases exponentially or at least at a greater and greater rate. The narrow end is called the throat and the wide end is called the mouth. The transducer is placed at the throat. When the diaphragm moves near the throat, we have a high pressure with a small amplitude in a small area. As the pressure wave moves towards the mouth, the pressure decreases and the amplitude increases. Excellent natural efficient amplification.

Acoustic horns are used in sound systems primarily for two reasons: (1) high efficiency (and the resultant high acoustic output with low distortion) and (2) pattern/coverage control. The ideal horn should have constant directivity and coverage angle and provide a constant acoustic load to the driver at all frequencies in the designed operating range of the horn. Up to now these goals were for the most part met by designs based on exponential horn theory. The exponential horn was found to be particularly effective in providing good response right down to horn cutoff, specially for the hyperbolic-exponential designs.

Horns have very special properties, including lower distortion, faster transient response than conventional drivers, and are easier to drive at high sound pressure levels than conventional drivers.

The exponential horn has an acoustic loading property that allows the speaker driver to remain evenly balanced in output level over its frequency range. A major drawback is that the exponential horn allows for a narrowing of the radiation pattern as frequency increases, making for high frequency 'beaming' on axis and dull sound off axis. Another concern is that a throat of small diameter is needed for high efficiency at high frequencies but a larger throat is best for low frequencies.

FIG. 2 shows effects of horn shape on cut off frequency of a horn. Again, the horn is comprised of 3 main parts: (1) The throat: the part that is connected to the speaker. (2) The neck: which describes the length of the horn, and (3) The mouth or the bell: which describes the end part of the horn, "connected" to the air. The speaker is connected at the throat of the horn, and radiates sound at the mouth of the horn. All of these parts influence how will the horn affect the overall sound. The flare and mouth design, the phase and direction of the particle velocity at the mouth, will all have an impact on the sound quality and directivity of the horn. One of the main characteristics of the horn is its shape. The horn has a certain taper, which is determined by the cross section expansion rate. The cross section area is determined by a function of distance, from the throat of the horn along its axis. Some common horn profiles are as follows:

(a) Parabolic: Easy to design and construct, but poor impedance conversion.

(b) Conical: Easy to design and construct, but poor impedance conversion.

(c) Exponential: Good wide band impedance conversion, but some nonlinearity.

(d) Hyperbolic: Very good and high impedance conversion, but relative nonlinearity.

(e) Stepped: High impedance conversion. Nonlinearity depends on step resolution. This shape is not like the others. The horn is not growing in a smooth fashion, but in abrupt square steps (imagine a cube, then a larger cube, and so on. The speaker plays through these cubes).

The main advantage of horn loudspeakers is they are more efficient; they can typically produce 10 times (10 dB) more sound power than a cone speaker from a given amplifier output. Therefore horns are widely used in public address systems, megaphones, and sound systems for large venues like theaters, auditoriums, and sports stadiums. Their disadvantage is that their frequency response is more uneven because of resonance peaks, and horns have a cutoff frequency below which their response drops off. To achieve adequate response at bass frequencies horn speakers must be very large and cumbersome, so they are more often used for midrange and high frequencies. The first practical loudspeakers, introduced around the turn of the 20th century, were horn speakers. Due to the development in recent decades of cone loudspeakers which have a flatter frequency response, and the availability of inexpensive amplifier power, the use of horn speakers in high fidelity audio systems over the last decades has declined.

A horn is an acoustic transformer, changing high pressure and low volume at the throat to low pressure and high volume at the mouth. It does so by slowly expanding the cross section of the tube down which the sound wave travels, and it creates an acoustic load for the driver as if it had a very large diaphragm, dramatically raising its efficiency.

A horn loudspeaker is characterized by several numbers; the area of the small end known as the throat, the wide end known as the mouth, the distance from the throat traveling down the length of the horn toward the mouth, and the expansion curve of the cross section of the horn as sound travels that distance. In an exponential horn, this expansion is given by the initial throat area multiplied by the natural logarithm (e) raised by a power factor related to the distance down the horn and the lowest frequency. FIG. 1 shows these elements and the formula giving the desired cross-sectional area, which is proportional to (e) raised to the power of 4*π times X inches divided by λ, the wavelength of the cutoff frequency.

The following equations are commonly used to determine various parameters associated with an exponential horn:

$$m = \frac{\ln\left|\frac{S_L}{S_0}\right|}{L}$$

$$f_c = \frac{mc}{4\pi}$$

$$S_L = \frac{\left(\frac{c}{2f_c}\right)^2}{\pi}$$

Where $f_c$ is lower cut-off frequency, m is flare constant, $S_L$ is the mouth cross-sectional area and $S_0$ is the throat area of the horn.

Every horn has a cutoff frequency. Below the cutoff frequency, a horn no longer works as an impedance transformer and the driver is then just pushing on the low impedance room air. At 60 hz, for example, one would need a horn dozens of feet in length. The cutoff frequency is determined by how rapidly the area increases, especially at the beginning of the horn where the pressure differentials are large. The more gradually the horn flares out, the lower the cutoff frequency will be.

One of the main disadvantage of a typical acoustic horn is that it is very large in dimensions which renders it unsuitable for it to be used with small scale modern electronic systems, such as smart phones, laptops, TVs, etc. In other words, conventional, prior art acoustic horn systems can not be miniaturized enough to be used with small electronic devices.

Miniaturization and integration of acoustic devices have been an important development in recent times. Consumer electronic devices, such as cellular phones, laptops, tablets, and the like with more features and capabilities are ubiquitous and are positioning to become audio entertainment centers. However, they exhibit severe audio deficiencies and pose many additional challenges to maintain the acoustic performance as enclosed acoustic volume size, power and membrane size are reduced significantly.

Recent consumer studies have indicated that people, in general, rate excellent sound quality as one of the most important features in an audio system and have less patience for poor sound quality. What is therefore needed in the art is an efficient way to propagate and amplify sounds over a broad frequency range in a small space. With the proliferation of handheld devices such as phones with small speakers, which are also used to play music, high tech games and the like, there is certainly a need for sound amplification with quality to catch up to the miniature size of the devices.

SUMMARY OF THE DISCLOSED TECHNOLOGY

A method of passively amplifying acoustic output of a loudspeaker over a broad frequency range (such as from 10 to 10,000 Hz) is disclosed. This is accomplished by aligning an opening into a single channel (defined as "a path through which sound travels from end to end") towards a conventional speaker (defined as "a device which converts electrical impulses to vibrations detectable as sound by a human ear"). The sound from the convention speaker is outputted substantially or fully in a direction of the opening so that the sound passes into the opening and then into the single channel. The channel itself is a single channel which zigzags while gradually increasing in width. The "zig-zag" pattern is created by a series of inward extending flanges into the channel which partially extend there-in, while the channel itself gradually increases in width. "Gradual," for purposes of this disclosure, is defined as "without a sudden change which causes a jagged edge" and/or "equally increasing in rate or value over a distance therein."

The opening into the single channel can be shaped like a funnel or cone whereby, in embodiments of the disclosed technology, an opening the size of a diameter of the conventional speaker or output therefrom in an electronic case is decreased in size until reaching that of the beginning of the channel at it's narrowest width. The funnel or cone can capture sound (which exits or emanates from) from the conventional speaker, this speaker being an internal speaker of an electronic device such as a phone or handheld transceiver. Further, two such conventional speakers can be on an electronic device and each one can be connected to a different single channel as described above. Each of the single channels can be mounted to a same housing which is attached to the handheld device, such as covering a some, a majority of, or substantially all of a back side of the handheld device.

The gradual increase described above can be an increase in a constant ratio starting at a narrowest width of 1.5 mm or less. The increase can be a linear increase or exponential increase at regular intervals. The regular intervals are such that a width between one of the regular intervals corresponds to length of the port opening (opening into the single channel) in some embodiments of the disclosed technology. The increase can instead be a geometric increase. The ratio of channel length to width remains constant as a distance or depth between inward extending prongs (flanges) decreases throughout the channel. The single channel turns back on itself and continues in an opposite direction in the zig-zag pattern (while continuing to increase in width) in some embodiments of the disclosed technology.

The variation in channel size may be realized in many distinct forms: linear, periodic, arithmetic, geometric, etc. The unique horn-like design can be achieved by various configurations. One of the possible ways is to change the channel width, while keeping the ratio of the channel length to width same over the horn length. It can also be achieved by changing the channel port opening and channel depth in an orderly fashion while keeping the channel width constant.

An array of sub wavelength single frequency channels, each resonating and amplifying at a different frequency, may be used in the high frequency range, which may not be fully covered by meta acoustic horn. Each channel is the length of an entire wavelength or a fraction thereof, such as ½ or ¼ of the wavelength so as to have a broad-band passive (acoustic and non-electrical) amplification effect. This is accomplished by having many/a plurality of different channels, each with an opening extending in a same, common, or substantially common direction. Thus, sound emanating from a speaker in a first direction continues in this direction until reaching and entering the openings of the plurality of channels.

The speaker used can be an internal speaker of an electronic device, such as a cellular phone which has cellular network connectivity, a display screen, a speaker, a microphone, and the like.

Any device or step to a method described in this disclosure can comprise or consist of that which it is a part of, or the parts which make up the device or step. The term "and/or" is inclusive of the items which it joins linguistically and each item by itself. "Substantially" is defined as "at least 95% of the term being described" and any device or aspect of a device or method described herein can be read as "comprising" or "consisting" thereof.

DETAILED DESCRIPTION OF EMBODIMENTS OF THE DISCLOSED TECHNOLOGY

Figure 1:
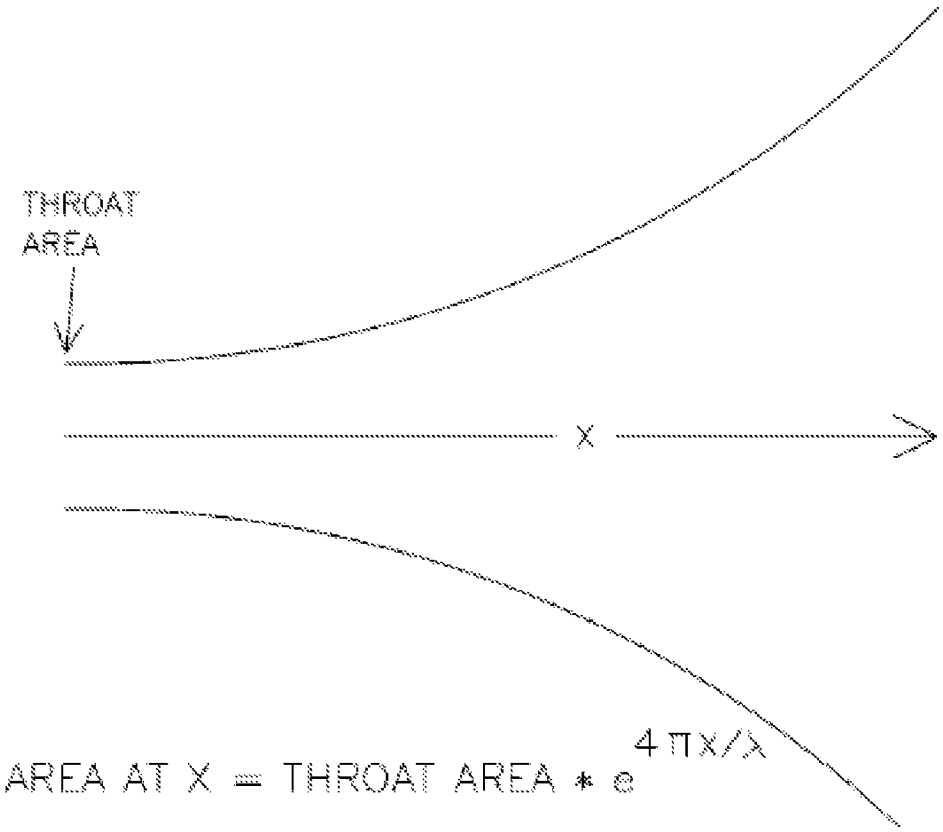
FIG. 1 shows a prior art exponential horn.
Figure 2:
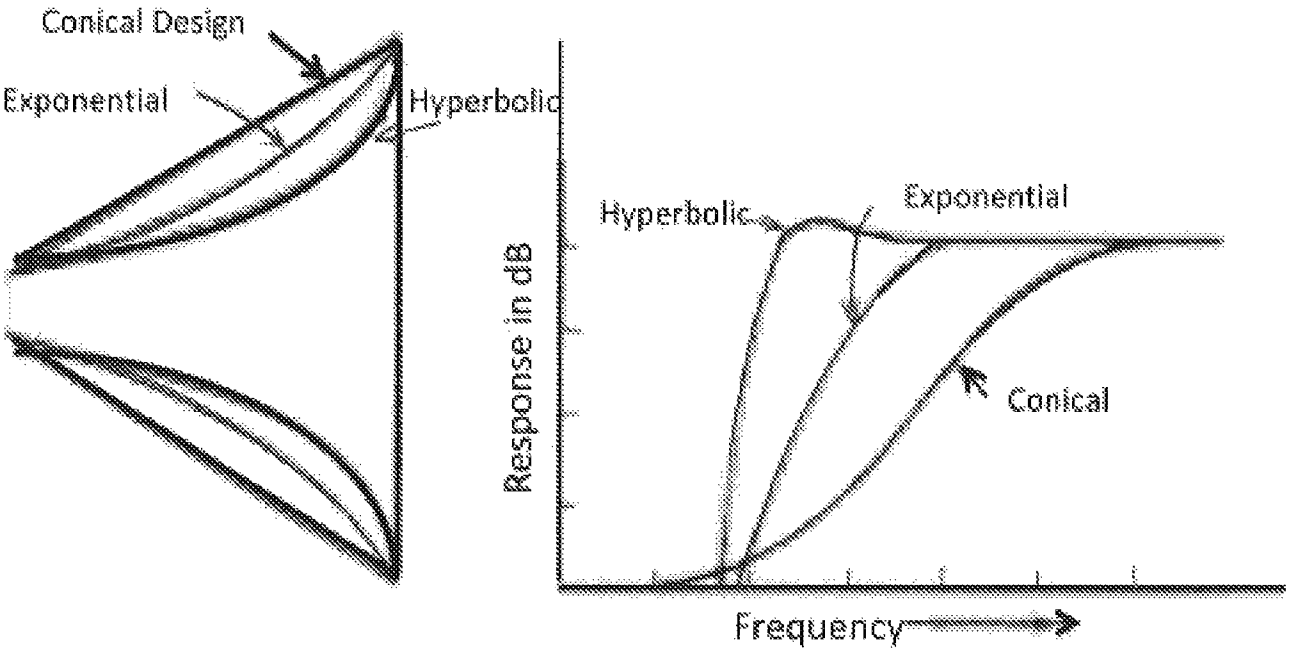
FIG. 2 shows a effect of horn shape on cut off characteristics.

Refraction is a phenomenon that often occurs when waves travel from a medium with a given refractive index medium, at an oblique angle, to another with different refractive index. Refraction occurs not only when light moves from water to air, but whenever the speed of light changes. Sound waves refract in the same way as light waves. At the boundary between the media, the wave's phase velocity is altered, usually causing a change in direction. Its wavelength increases or decreases, but its frequency remains constant. Refractive index is defined as the factor by which the wavelength and the velocity of the propagating wave are reduced in the medium with respect to their vacuum values as it passes through. When light passes from air to water it slows down, whereas when sound travels from air to water it speeds up. Therefore sound is refracted away from the normal, whereas light is refracted towards the normal. The speed of sound is greater in water than in air, so the wavelength in water is greater than in air. In effect the refractive index of the water is less than the refractive index of the air. Snell's Law describes the relationship between the angles and the velocities of the waves. Snell's law equates the ratio of material velocities $V_1$ and $V_2$ to the ratio of the sin's of incident ($\theta_1$) and refracted ($\theta_2$) angles, as shown in the following equation.

$$\frac{\sin\theta_1}{\sin\theta_2} = \frac{V_{L1}}{V_{L2}} = \frac{n_2}{n_1}$$

Where:

$V_{L1}$ is the longitudinal wave velocity in material 1, $V_{L2}$ is the longitudinal wave velocity in material 2, and $n_1$ and $n_2$ are refractive indices of the two mediums.

For miniature acoustic devices, acoustic mediums with high refractive index are desired to slow down the speed of sound waves, since refractive index of a medium determines the propagation speed of the sound wave. However, it is difficult to find a naturally occurring material with acoustic refractive index higher than that of air for sound waves propagating in air. In acoustics, slow sound is a relatively new and remarkable concept with applications to audio systems. Acoustic meta material theory offers a way to design acoustic materials with high refractive index and correspondingly slow sound speed. Broadband audible range sound can be manipulated and focused on a sub-wavelength scale, that is, on a scale much smaller than the wavelength in air, and from the far field using sub-wavelength acoustic resonators. For this purpose, a miniature sub-wavelength horn-ike channel is used in the present invention.

Acoustic waves with frequencies above a given cutoff value propagate along an elongated path within an assembly of zig-zag channels. The elongated path of the acoustic wave leads to the occurrence of a phase delay in the transmitted wave and, consequently, a higher refractive index (or slow sound speed) is realized. When the channel width (D) is sufficiently small with respect to the wavelength, the relative refractive index of the coiled structure (nr: effective refractive index of coiled structure normalized by the original fluid index) can be precisely calculated using the path length of the acoustic wave.

Because evanescent waves are bound to a source, they must be converted into propagating waves by lessening their momentum for propagating them to the far-field. Such a conversion can be obtained using anisotropic media. However, for such a phenomena to occur and to achieve the required medium, high refractive index material is desired. But for acoustic waves propagating in air, it is difficult to find a natural material with refractive index higher than air. It may be noted that water has a lower refractive index than air. Acoustic meta materials (AMM) allow broadband sound to be manipulated on a sub-wavelength scale, that is, on a scale much smaller than the wavelength in air, and from the far field using sub-wavelength acoustic resonators.

The problem has been solved in this patent by using a meta material horn like single channel device having mouth opening as small as 1.5 mm or less. A single horn channel, for a conventional speaker which outputs sound over a broad frequency range (e.g. less than 10 Hertz to 10,000 Hertz or more) can be used in this manner. The single channel itself is a zig-zag channel while gradually increasing in width. The "zig-zag" pattern is created by a series of inward extending flanges into the channel, which partially extend there-in, while the channel itself gradually increases in width.

Refraction of sound wave-fronts can be achieved by inducing sound speed or velocity gradient in the direction of lower sound speed. The propagation of sound in a zig-zag channel, as devised in this patent, induces sound velocity gradient in the channel and hence produces refraction of sound.

Further embodiments of the disclosed technology will become more clear in view of the following description of the Figures.

Figure 3B:
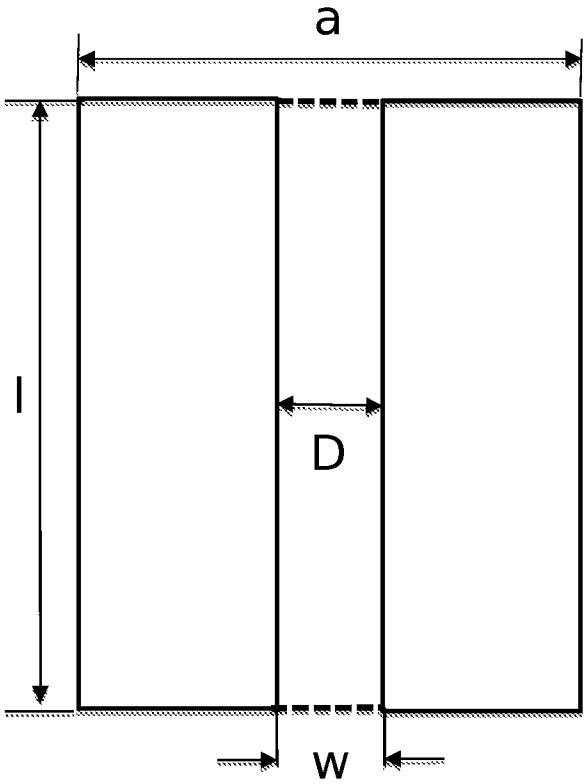
FIG. 3B shows straight path channel having a width equal to that of the zig-zag channel shown in FIG. 3A for comparison purposes.
Figure 3A:
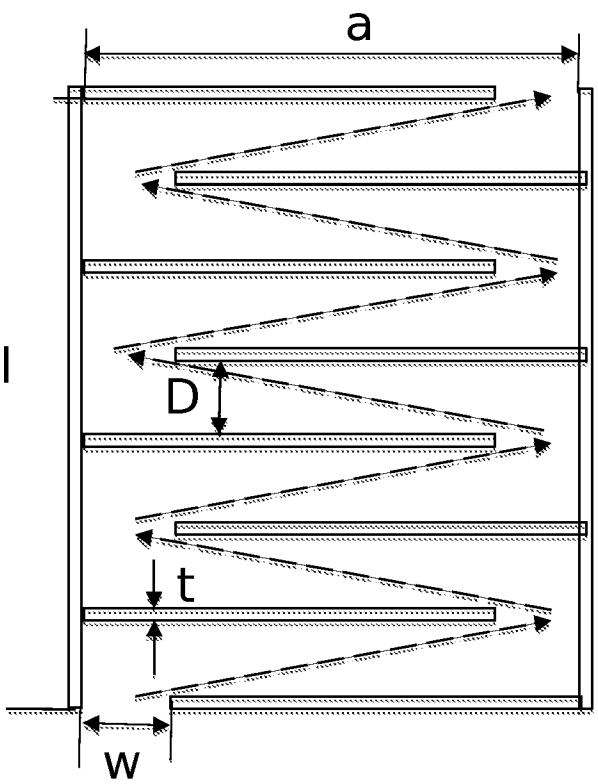
FIG. 3A shows a zig-zag meta acoustic channel having high refractive index as used in embodiments of the disclosed technology.

FIG. 3A shows a zig-zag meta acoustic channel having high refractive index as used in embodiments of the disclosed technology. D is the distance between adjacent prongs or inward extending flanges while the dotted line arrow is the path of the sound. There is an opening w into the single channel which has a width a and a total height or length 1. FIG. 3B shows straight path channel having a width equal to that of the zig-zag channel shown in FIG. 3A for comparison purposes. As such, on the right side, the equivalent straight path channel is shown. This is used to demonstrate the relative refractive index which can be expressed as:

$$n_r = \frac{l_{eff}}{t}$$

where, t is the overall length of the coiled structure and $l_{eff}$ can be estimated as:

$$l_{eff} \approx N \times L$$

where N represents the number of zig-zag channels and L is length of each branch, and is expressed as:

$$L = \sqrt{(a-D)^2 + (D+w)^2}$$

Given the expression for the relative refractive index of the zig-zag channel structure, it can be represented by an equivalent model of the same dimensions but comprised of a straight channel filled with a medium of refractive index of $n, n_0$ (shown in FIG. 3B) in which no represents the refractive index of the original fluid. Hence, such a zig-zag air channel is equivalent to a straight channel filled with an effective medium of high refractive index (or low sound speed).

Figure 4:
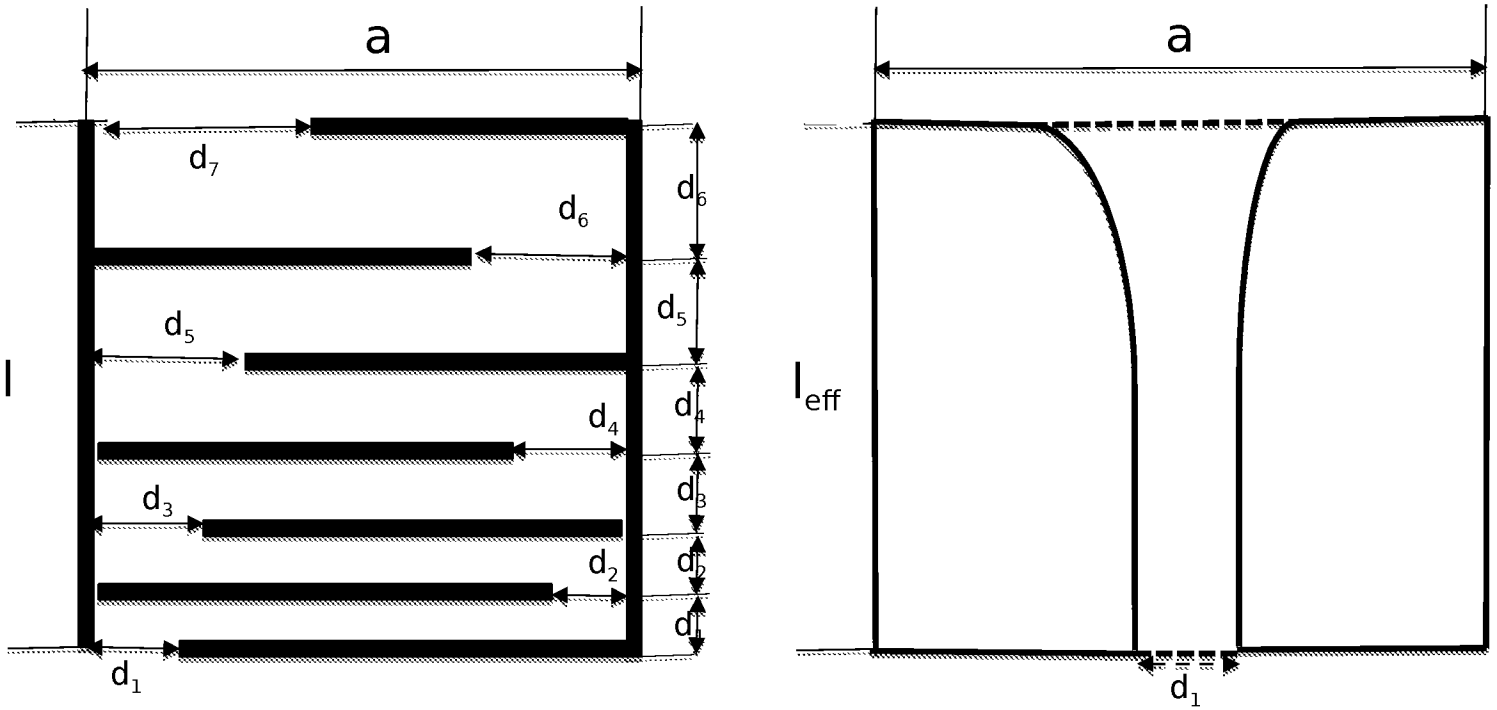
FIG. 4 shows a meta acoustic horn zig-zag channel system used in embodiments of the disclosed technology.

FIG. 4 shows a meta acoustic horn (MAH) zig-zag channel system used in embodiments of the disclosed technology. Here, an opening into the single channel has a width of d and the opening into each sub-wavelength resonant region $d_2$ through $d_7$ is part of zig-zag pattern with inward extending prongs. Note that the distance of each zig-zag region had a different depth (a portion of the total length 1) but a same length a in this embodiment.

Figure 5:
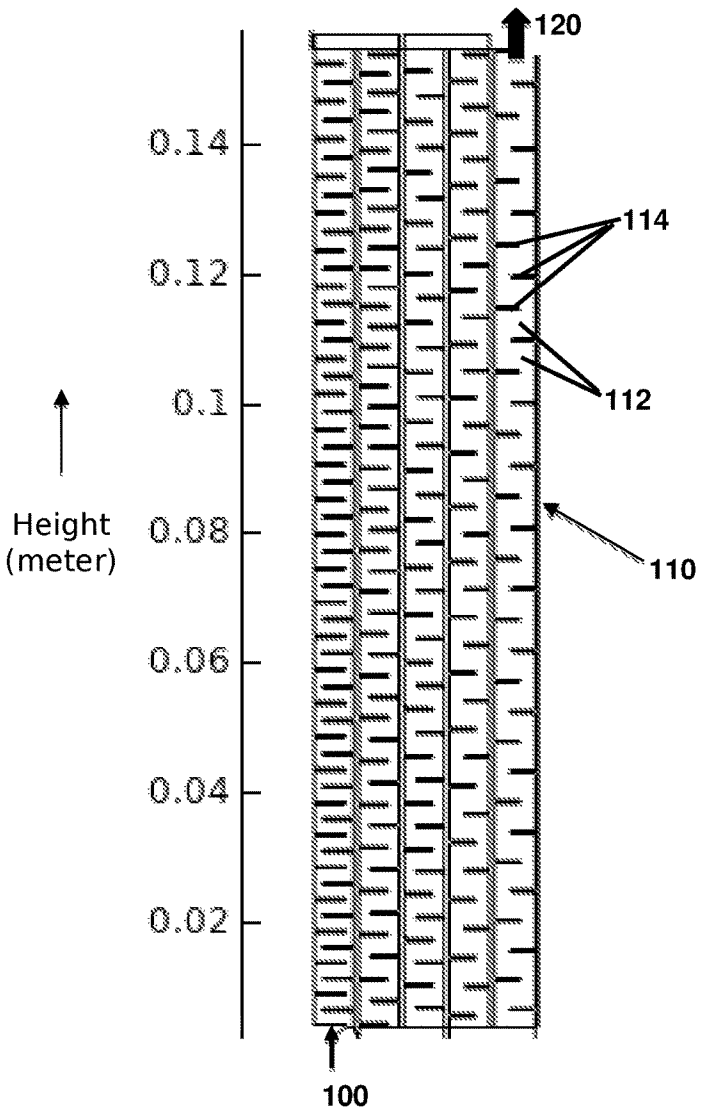
FIG. 5 shows a meta acoustic horn with increasing width in an embodiment of the disclosed technology.

FIG. 5 shows a meta acoustic horn (MAH) with increasing width in an embodiment of the disclosed technology. The two-dimensional sketch of an acoustic meta material horn channel to realize high refractive index, which is comprised of a periodic array of sub-channel units 112 attached to an air waveguide 100 (device which guides the waves into the narrow channel opening) at the base with incoming acoustic signal. The sub-wavelength zig-zag channels are divided into the resonant sub-channel units 112 by inward extending prongs or flanges 114. This is a zig-zag pattern of what, in the prior art, might be a horn shape such as shown in the right side of FIG. 4. Although, the number of zig-zag sub-channels required in a housing, to achieve high refractive index can be large for a MAH horn, the MAH horn amplifier can still be compact. The number of sub (or zig zag)-channels in a single MAH horn depends on the total distance traveled by sound waves. Since sound waves are forced to travel inside sub-channels for the required distance, whose optimum length can be calculated, their speed reduces.

The MAH horn channel is an anisotropic system with a high refractive index medium (where sound passes through the pathway cut into the device 110 at a ratio of at least 10:1 compared to passage through the solid medium) used in an embodiment of the disclosed technology. A zig-zag pattern of the channel with increasing port opening and channel width presents changing acoustic impedance to sound waves.

Figure 6:
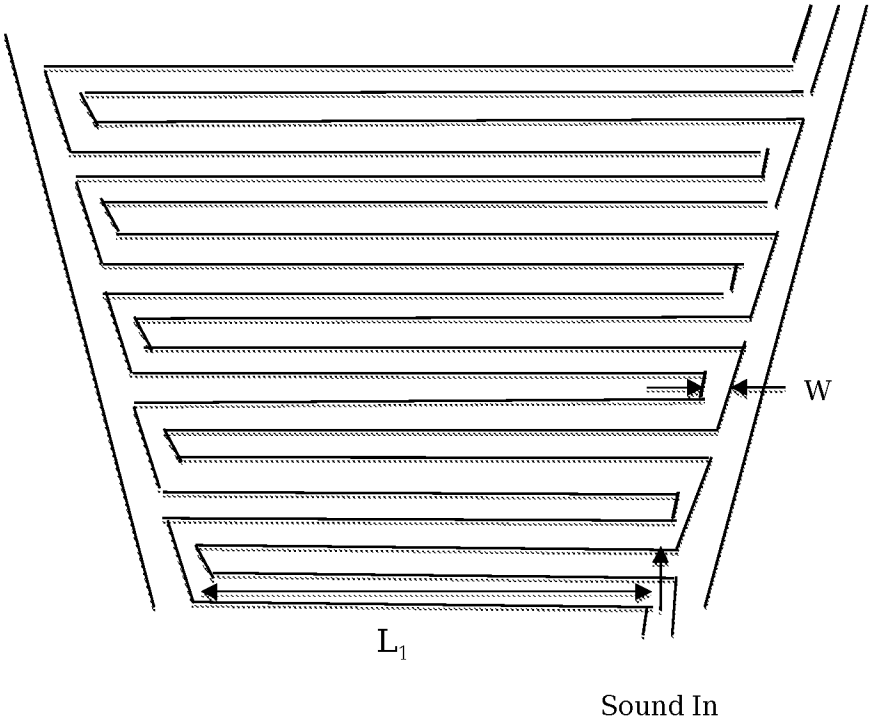
FIG. 6 shows an alternative configuration of horn channel system of embodiments of the disclosed technology.

FIG. 6 shows an alternative configuration of horn channel system of embodiments of the disclosed technology. Here, the channel zig-zags back and forth as the width within the channel increases and the total distance further increases or stays the same. This can also be optimized for the desired frequency range.

Figure 7:
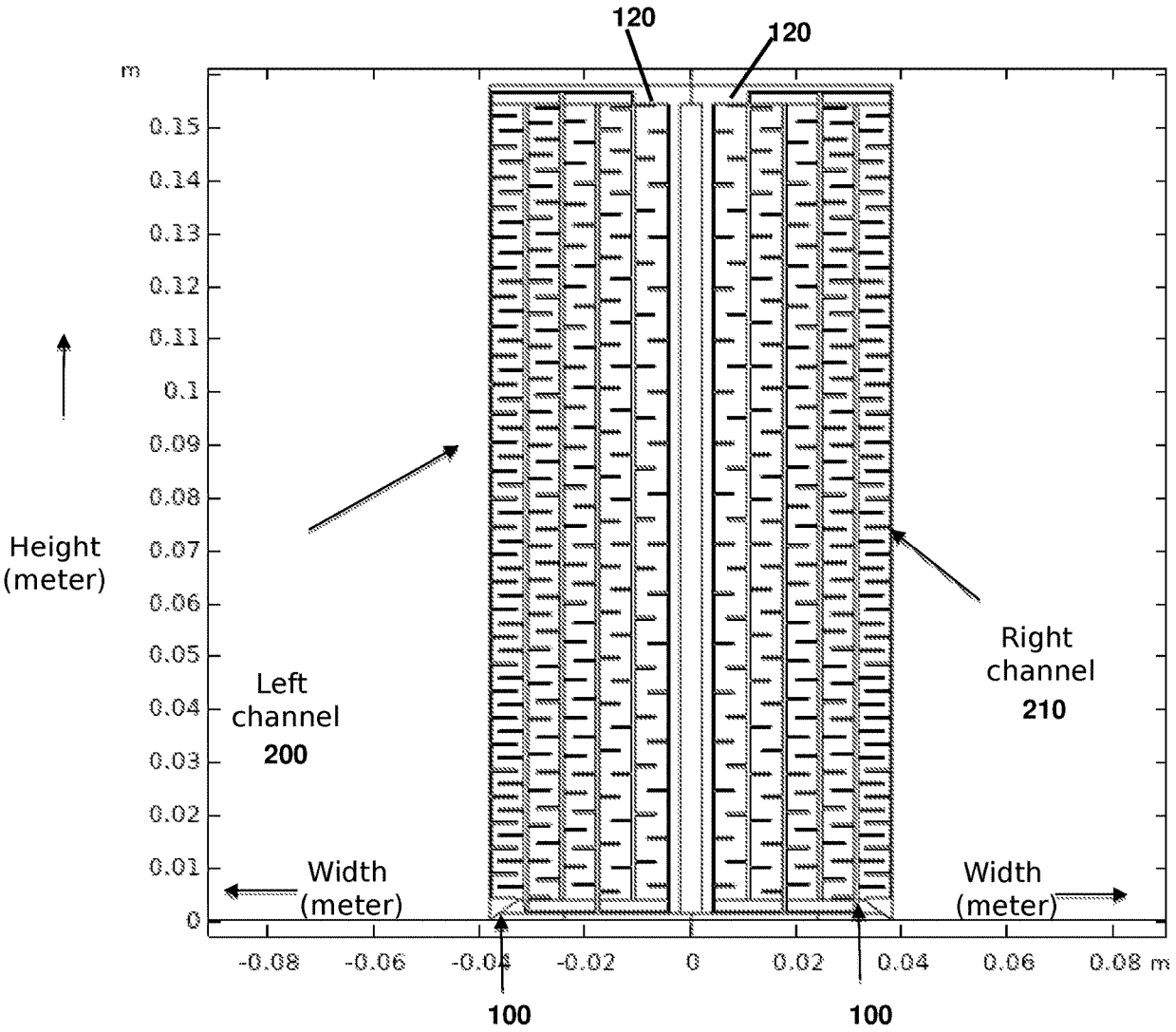
FIG. 7 shows two single channels placed side by side in an embodiment of the disclosed technology.

FIG. 7 shows two single channels placed side by side in an embodiment of the disclosed technology. Here, a left channel 200 and right channel 210 are substantially identical or are identical except perhaps for a wave guide 100 which may be different shaped, such as a different cone or funnel, to accommodate the output shape and position of a conventional speaker. The channels 200 and 210 zig-zag and the width or spacing between prongs becomes greater and greater allowing, at each sub-channel area between each two adjacent prongs, a different frequency to be amplified starting at higher frequencies and becoming lower as the spacing between prongs increases. The heights and widths shown in the figure are by way of example and not limitation.

Figure 8:
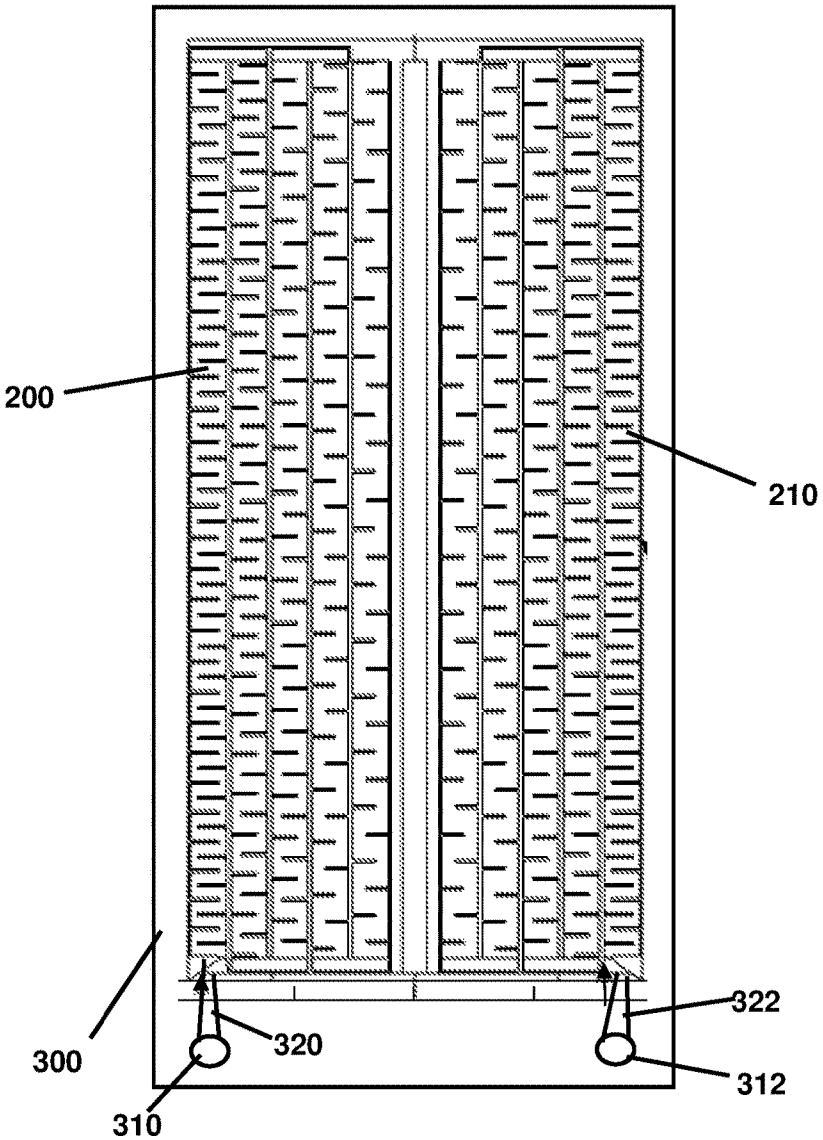
FIG. 8 shows the embodiment of FIG. 7 on the back of an electronic device.

FIG. 8 shows the embodiment of FIG. 7 on the back of an electronic device. Here, conventional speakers 310 and 312 or vents/portals into a housing 300 of an electronic device are covered by funnels 320 and 322 respectively. The funnels move or guide the sound into the respective left channel 200 and right channel 210. The channels can cover a majority of or substantially all of a back side of a handheld electronic device such as a cellular phone. Such channels can be fitted inside a housing of an electronic device as well with a conventional speaker passing sound substantially or fully through the channel before the sound exits from the housing of the electronic device.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein-above are also contemplated and within the scope of the disclosed technology.

The invention claimed is:

1. A method of passively amplifying acoustic output of a speaker over a broad frequency range, comprising:

aligning an opening into a single acoustic channel towards a conventional speaker, said channel extending in a direction which is laterally back and forth as well as in a direction transverse to said laterally back and forth direction;

outputting sound through said conventional speaker substantially in a direction of said opening;

wherein said channel is arranged such that each laterally back and forth region is, in combination with each other, an array of sub-wavelength single frequency lateral regions which each resonating and amplify at least one different frequency while gradually increasing in width, said width being in said tranverse direction.

2. The method of claim 1, wherein said opening into said single acoustic channel is a funnel, waveguide, or cone.

3. The method of claim 2, wherein said funnel, waveguide, or cone captures sound from said speaker, said speaker being an internal speaker of an electronic device.

4. The method of claim 3, wherein said gradually increasing width gradually increases linearly, in a constant ratio, from a opening of less than 1.5 mm in width using a medium which has a higher refractive index than air manipulating sound on a sub-wavelength scale.

5. The method of claim 4, wherein said gradually increasing width gradually increases exponentially at regular intervals in a stepwise fashion.

6. The method of claim 5, wherein said regular intervals are such that a width between one of said regular intervals corresponds to length of said port opening.

7. The method of claim 2, comprising carrying out said steps of aligning and outputting to a different said single channel for each of two of said internal speakers of said electronic device;

wherein each said different said single channel extends in a same direction enabling placement of two said different said single channels on a back of said electronic device with said internal speakers on a same side edge of said electronic device.

8. The method of claim 7, wherein said gradually increasing is a geometric increase.

9. The method of claim 1, wherein a ratio of length of inward extending prongs decreases in a 1:1 correspondence with width in said transverse direction of each said back and forth section throughout said single channel.

10. The method of claim 1, wherein said direction which is said transverse to said laterally back and forth direction includes extending in a first transverse direction and then extending in a second transverse direction which is in a direction opposite said first transverse direction such that said single acoustic channel turns back on itself.

11. A single channel which amplifies a variety of frequencies comprising:

a single zig-zag path wherein after each iteration of said path turning back upon itself the a width increases in a regular interval corresponding to a sub-wavelength or wavelength frequency of sound to be amplified;

a first opening into said single channel at a narrowest end;

a second opening into said single channel at a widest end;

where said channel reverses direction at least once while continuing in said zig-zag path such that a portion of said zig-zag path is in parallel to another portion of said zig-zag path such that said zig-zag path extends transverse to each said zig-zag in two opposite directions to each said zig-zag;

a wave guide designed to direct sound from a conventional speaker into said single zig-zag path.

12. The single channel of claim 11, wherein said single channel is attached to a housing which fits at least substantially inside or over a side of an electronic device.

13. The single channel of claim 12, wherein two single channels are within said housing, each said single channel placed to receive sounds from a different said conventional speaker built into said electronic device.

14. The single channel of claim 11, wherein said increasing width increases linearly from said first opening, and said single channel has a narrowest port opening of less than 1.5 mm.

15. The single channel of claim 11, wherein said increasing width is at regular intervals.

16. The single channel of claim 11, wherein said increasing width is a geometric increase in width.

17. The single channel of claim 11, wherein said channel turns back on itself and continues in an opposite direction is said zig-zag pattern, wherein said turns correspond to a length which is less than a total length of an housing which is, in turn, adapted to attach to an electronic device.

18. The single channel of claim 17, wherein a ratio of channel length to width remains constant as a distance or depth between inward extending prongs decreases throughout said single channel.

* * * * *